US005766693A

United States Patent [19]

Rao

[11] Patent Number: 5,766,693

[45] Date of Patent: Jun. 16, 1998

[54] METHOD OF DEPOSITING COMPOSITE METAL COATINGS CONTAINING LOW FRICTION OXIDES

[75] Inventor: V. Durga Nageswar Rao, Bloomfield, Mich.

[73] Assignee: Ford Global Technologies, Inc., Dearborn, Mich.

[21] Appl. No.: 540,141

[22] Filed: Oct. 6, 1995

[51] Int. Cl.[6] ..... C23C 4/10

[52] U.S. Cl. ..... 427/454; 427/453; 427/455; 427/456

[58] Field of Search ..... 427/446, 453, 427/454, 455, 456

[56] References Cited

U.S. PATENT DOCUMENTS

| | | | |
|---|---|---|---|
| 1,347,476 | 7/1920 | Allyne . | |
| 3,640,757 | 2/1972 | Grubba . | |
| 3,900,200 | 8/1975 | Nakamura | 277/235 A |
| 3,935,797 | 2/1976 | Niimi et al. | 92/223 |
| 4,256,779 | 3/1981 | Sokol et al. | 427/446 |

OTHER PUBLICATIONS

Thermal Spraying:Practice, Theory, and Application, American Welding Society, Inc. 1985, p. 27 (no month date).

*Primary Examiner*—Katherine A. Bareford

*Attorney, Agent, or Firm*—Joseph W. Malleck

[57] ABSTRACT

Method of depositing a metal base coating containing a self-lubricating oxide phase and one or more wear resistant phases, by: preparing at least one light metal substrate surface to be essentially oxide-free and in a condition to adherently receive the coating, plasma spraying a supply of metal (M) powder particles onto the substrate surface to produce a composite coating of such metal (M) and an oxide ($MO_x$) of such metal that has the lower oxygen content of any of such metal's oxide forms, the plasma being formed by introduction of a primary plasma gas through an electric arc/electromagnetic field to ionize the primary gas as a plasma stream which stream envelopes each particle of the introduced powder, the powder particles being introduced to the plasma stream by an aspirating gas and being melted or plasticized substantially only at a surface region of each particle by the heat of the plasma; the primary plasma gas being constituted of a reactively oxide-neutral gas, but including a reducing gas component particularly when the oxide form of such powder is less than 90% $MO_x$, and the aspirating gas being constituted of a reactively oxide-neutral gas, but including an oxidizing component if the volume content of the $MO_x$ form of the powder is less than 5% or it is desired to increase the volume of the oxide form $MO_x$ of the powder.

18 Claims, 3 Drawing Sheets

METHOD OF DEPOSITING COMPOSITE METAL COATINGS CONTAINING LOW FRICTION OXIDES

BACKGROUND OF THE INVENTION

1. Technical Field

This invention relates to the technology of providing wear resistant coatings on light metal substrates and more particularly to metal based coatings containing a self-lubricating wear resistant phase in the form of such metal's oxide that has the lowest oxygen content.

2. Discussion of the Prior Art

Cast iron has been the material of choice for cylinder bores from the earliest days of making internal combustion engines. Several types of coatings have been tried to improve corrosion resistance, wear resistance and to reduce engine friction. An early example of such coating is nickel plating that enhanced corrosion resistance of the iron substrate. This offered only limited reduction of friction (see U.S. Pat. No. 991,404). Chromium or chromium oxide coatings have been used selectively in later years to enhance wear resistance of engine surfaces, but such coatings are difficult to apply, are unstable, very costly and fail to significantly reduce friction because of their inability to hold an oil film; such coatings additionally have high hardness and often are incompatible with steel piston ring materials.

The advent of aluminum engine blocks, to reduce overall engine weight and to improve thermal conductivity of the combustion chamber walls for reducing $NO_x$ emissions, necessitated the use of cylinder bore coatings or use of high silicon aluminum alloys with special surface preparation. Recently, aluminum bronze coatings have been applied to aluminum engine bores in the hopes of achieving compatibility with steel piston rings. Unfortunately, such aluminum bronze coatings are not yet desirable because the coating's durability and engine oil consumption are not as good as a cast iron cylinder bore. In more recent years, iron or molybdenum powders have been applied to aluminum cylinder bore walls in very thin films to promote abrasion resistance. Such systems do not control the oxide form so as to yield a low enough coefficient of friction that would allow for appreciable gains in engine efficiency and fuel economy. For example (and as shown in U.S. Pat. No. 3,900,200), plasma sprayed $Fe_3O_4$ particles were deposited onto a cast iron substrate to obtain an increase in wear resistance (scuffing and abrasion resistance). Such coating does not obtain or is it aimed at the beneficial effect of a friction reducing phase. Similarly, in U.S. Pat. No. 3,935,797, an iron powder coating of 0.3% carbon was plasma sprayed onto an aluminum substrate propelled by spray of inert gas resulting in an iron and iron oxide coating that inherently contained $Fe_3O_4$ due to the excess of $O_2$ drawn in by the spray action of the propellant. To decrease scuffing, a phosphate coating was needed over the iron and iron oxide.

SUMMARY OF THE INVENTION

It is an object of this invention to provide an effective method of thermally spraying light weight metal substrates with a metal or metal alloy powder by use of controlled plasma gases and powder aspirant gases that ensure formation and/or retention of the metal's lower oxygen form of oxide which can function as a self-lubricating phase. It is further an object to control and use such gases to additionally form hard wear resistant particles during the spraying process (nitrides and carbides) that become commingled in the coating with the self-lubricating phase.

The invention herein, meeting such objects, has the following steps: (a) preparing at least one metal substrate surface to be essentially oxide free and in a condition to adherently receive the coating, (b) plasma spraying a supply of metal (M) powder particles onto the substrate surface to produce a coating of such metal (M) and an oxide ($MO_x$) of such metal that has the lowest oxygen content of any of such metal's oxide forms, the plasma being formed by introduction of a primary plasma gas to an electromagnetic field to ionize the gas as a plasma stream which stream envelopes each particle of the introduced powder, the powder particles being introduced to the plasma stream by an aspirating gas and being melted or plasticized substantially only at a surface region of each particle by the heat of the plasma, (i) the primary plasma gas being essentially constituted of a reactively oxide-neutral gas but including a reducing gas component when the oxide of the powder is less than 90% MO, (ii) the aspirating gas being essentially constituted of a reactively oxide-neutral gas but including an oxidizing component when the volume content of the oxide form (Mo) of the powder is less than 5% by volume or it is desired to increase the volume of the oxide form (MO) of the powder to substantially over 5% in the coating.

DETAILED DESCRIPTION AND BEST MODE

The method of this invention for depositing a metal based coating containing a self-lubricating oxide phase (MO), comprises three steps in the preferred embodiment. First, the light metal substrate (i.e., aluminum magnesium or alloys of each) surface is prepared to be essentially dirt free, grease free, oxide free and in a condition to adherently receive coatings thereover. Next, a supply of metal powder is plasma sprayed onto the substrate surface to produce a composite coating of (a) the metal (M) and (b) an oxide of such metal (MO) that has the lower amount of oxygen of any such metal's oxide forms and has the easier glide planes in the molecular structure of the metal's oxides. The plasma is formed by the introduction of a primary plasma gas which is passed through an electromagnetic field to ionize the primary gas as a plasma stream which stream envelopes each of the particles of the introduced powders; the powder is introduced to the plasma stream by an aspirating gas and is melted or plasticized only at a surface region of each of the particles by the heat of the plasma. The primary plasma gas is constituted of a reactively oxide-neutral gas but may include a reducing gas component, particularly when the oxide form in the coating is designed to be is less than 90% of MO; the aspirating gas is constituted of a reactively oxide-neutral gas but includes an oxidizing component if the volume content of the oxide form MO of the powder supply is less than 5% or it is desired to increase the oxide MO volume to substantially over 5% in the coating. Lastly, the exposed surface of the coating is smoothed to induce a hydrodynamic oil film thereon when oil is applied to the pores of the coating during operative sliding contact use. A thermally deposited bond coating between the substrate and coating is desirable, such as nickel-aluminum (80–95% Ni+remainder Al, by weight) or steel-aluminum (80–95% stainless steel+remainder Al) or nickel-chromium (80% Ni+remainder Cr) composites.

Figure 1:
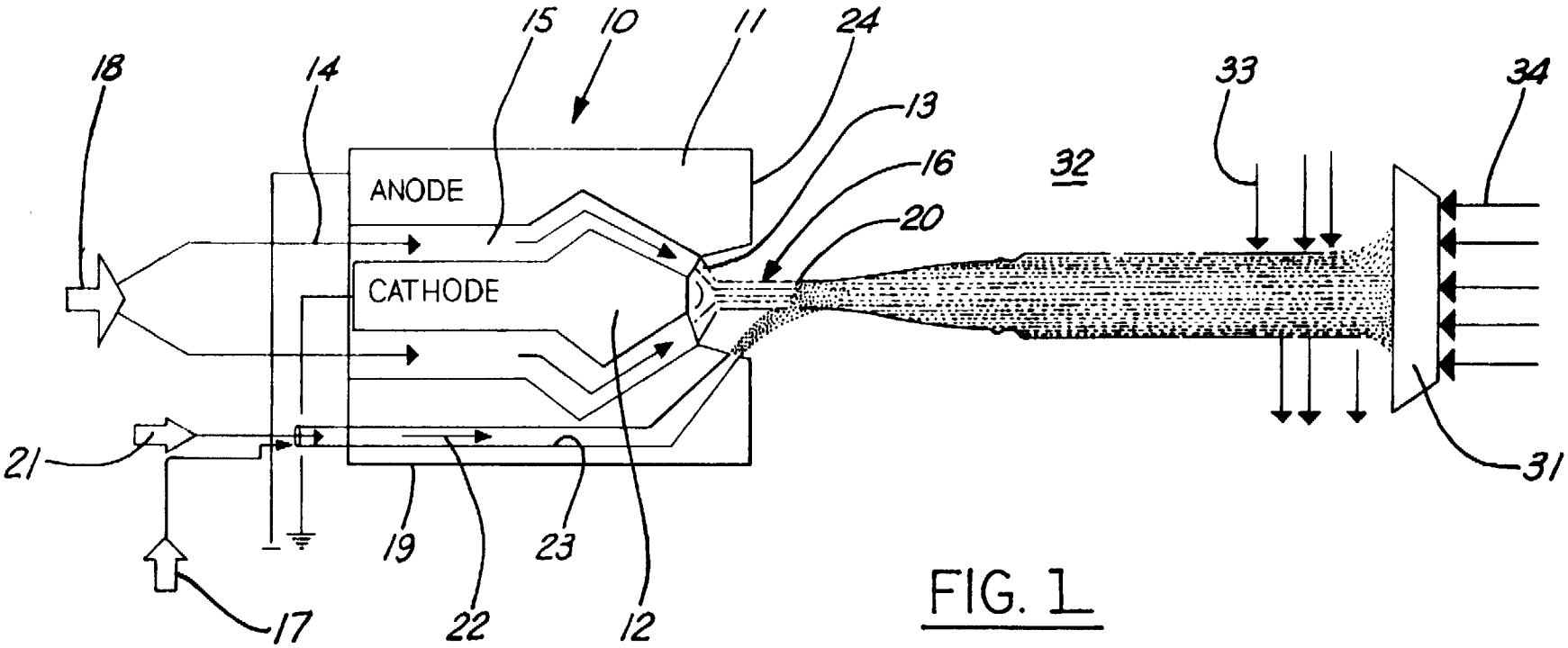
FIG. 1 is a schematic illustration of the plasma spraying process using a plasma gun to deposit a sprayed coating on a light weight substrate.
Figures 2, 3, 4, 5:
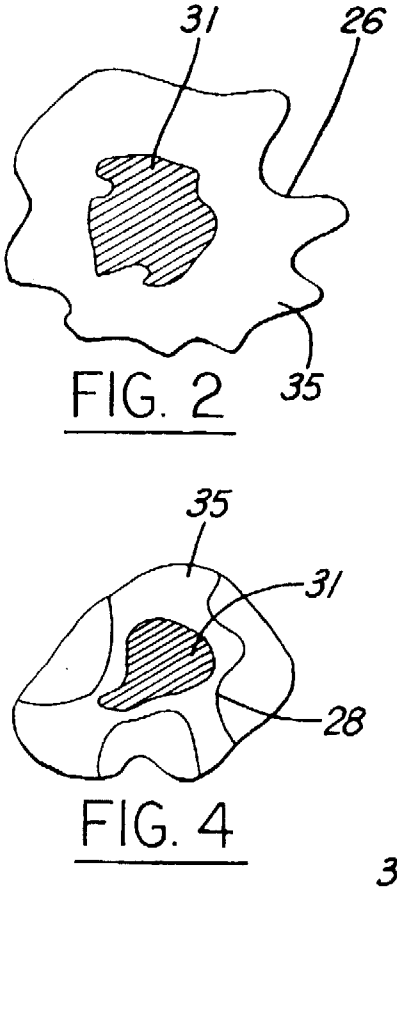
FIGS. 2 is a highly enlarged view of a water atomized powder particle used in the process of FIG. 1.
FIG. 3 is a highly enlarged view of a sponge iron particle used in the process of FIG. 1.
FIG. 4 is a chopped low alloy steel wire particle used in the process of FIG. 1.
FIG. 5 is a highly enlarged view of a low alloy steel particle used in the process of FIG. 1.

As shown in FIG. 1, powder plasma spraying is effected by use of a gun 10 that creates an electric arc and electromagnetic field 13 between anodic and cathodic nozzle elements 11, 12; such arc or field 13 strips electrons from a primary pressurized gas flow 14 that is introduced into an annular space 15 between the elements. The gas forms an ionized plasma stream 16 after passing through the arc 13 struck between the closest spacing of the elements 11, 12. The supply 18 for the primary gas enters the nozzle 19 at a pressure of about 20–75 psi and mass flow rate of about 45–100 standard liters per minute and exits as a plasma 16 with a velocity of about 700–3000 meters per second and a temperature of about 3500° C. The plasma temperature drops outside the nozzle such as at location 20 to a temperature of about 3000° C. A metallic powder supply 21 is aspirated into the plasma as a stream 22 carried by an aspirating gas 17 pressurized at about 5–60 psi and having a mass flow rate of about 2–6 standard liters per minute. The stream 22 passes through a channel 23 in the nozzle body and it is directed to intersect the plasma stream outside the gun, preferably at a location 20 about 0.05 to 1.0 centimeters from the face 24 of the gun. The plasma stream 25 eventually strikes a substrate 31 which desirably is an aluminum cylinder bore wall (or other light metal or even in some extreme cases cast iron or steel) of an internal combustion engine block. The aluminum is extremely helpful; it quickly conductively transfers the heat of the deposited coating to a cooling medium 34 to assure proper solidification and recrystallization of the deposited coatings. The plasma if properly focused, experiences little turbulence to induce air from the surrounding environment 32 into the stream. Cross-currents 33 can be eliminated by masking the end of the cylinder bore.

The metallic supply 21 has (i) a defined chemistry consisting of a base metal (M) that readily forms multiple oxides (M being selected from the group of Fe, Ni, Cu, Mo and alloys thereof) and a restricted oxygen content that does not exceed 1% by weight, (ii) a particle size that is preferably in the range of 40–150 microns to facilitate smooth coating deposition, and (iii) preferably a particle shape that is irregular to generate or induce porosity in the deposited coating. Fe, Ni, Mo and Cu and their alloys are used because of their ability to form multiple oxide forms but also because of their acceptability to the manufacturing environment, being devoid of toxicity and being volatile. Examples of Fe base metal powders that meet such conditions include: (a) molten iron atomized by steam or argon and annealed to a carbon level of 0.15–0.45% by weight; (b) sponge iron resulting from reduction of magnetite or hematite by water and CO (carbon annealed to 0.15–0.45% by weight); (c) steel in the form of comminuted wire or steam atomized particles that possess low carbon and low alloying ingredients such as nickel, chromium, molybdenum, and aluminum (carbon being equal to or less than 0.5% by weight, and the alloying ingredients being preferably less than 25% total and preferably equal to or less than 5% for Mo, 5% for Mn, 20% for nickel, 20% for chromium, and 6% for aluminum.

Examples of nickel base metal powders that meet such conditions include steam or argon atomized nickel or nickel alloy powder and comminuted nickel or nickel alloy powder; the nickel powder may have a chemistry such as: (a) 80 Ni—18 Cr—2 Al; (b) 60 Ni—22 Fe—18 Cr; and (c) 50 Ni—10 Mo—20 Cr—20 Fe. Examples of copper base metal powders that meet such conditions include atomized or comminuted powder that have the following chemistry: (a) Cu+2–6%Al; and (b) Cu+2–4 Al/20–30 Zn.

The shape of the individual particle types are respectively shown in FIGS. 2–5. Note that the irregular outer contour 26 of steam atomized powder (FIG. 2), the highly irregular pits 27 of sponge metal that traps porosity (FIG. 3), the deep indentations 28 of chopped wire particles (in FIG. 4), and the undulated surface 29 of steam atomized metal particles containing hard intermetallic compounds 30 (see FIG. 5). Each of the particles, as shown, have a solid core 31 (cross-hatched) that is not melted or plasticized by the plasma process, and an outer zone or region 35 that is melted or softened and recrystallized on hitting the substrate 31. It should be noted however that the powder feed rates, particle size range, as well as plasma conditions control the degree of melting of the particles. If the particles are smaller than 30 microns such particles may be completely molten. For coarser particles only the surface will be melted.

It is important to control the process so that plasma spraying creates in the coating a composite mixture of the metal (M) (selected from the group of nickel, copper, molybdenum, iron and alloys thereof) and an oxide ($MO_x$) that is (i) stable and contains holes or sites in the crystal lattice where M is absent, (ii) possesses the least or lower amount of oxygen of any of such metal's oxides forms, and (iii) provides the easiest glide planes in the molecular structure of any of such metal's oxide to produce the lowest coefficient of friction. For iron, such oxide would be FeO, for nickel the oxide would be NiO, for copper it is $Cu_2O$, and for molybdenum it is $MoO_3$. "x" is 0.95–1.05 for Fe, 0.75–1.25 for Ni, 0.4–0.6 for Cu, and 2.5–3.2 for Mo. Such oxides with holes in the crystal lattice have atoms arranged in the oxide crystal creating ready slip planes so that the oxide crystals can shear or cleave easily along such planes and therefore allow gliding under pressure with little friction. Shear is easier with such oxide forms because the molecular structure has a number of holes where oxygen atoms would otherwise appear. Crystal structures with "holes" in the crystal lattice can yield oxides that behave like a self lubricating phase when subjected to high pressure and sliding action. This results from the transformation and preferred orientation of the lower oxides form to align high atomic density planes parallel to direction of the motion and perpendicular to the applied load, it is believed.

Unfortunately, exposure of each of the above base metals to oxygen, can result in the formation of a variety of crystal structures under varying conditions, such as temperature and oxygen concentration. For example, iron will form $Fe_3O_4$ at temperatures 700°–1200° C. in the presence of excess oxygen, $Fe_2O_3$ at temperatures about 800°–1400° C. in the presence of excess oxygen, and FeO at temperatures of 300°–1300° C. in the presence of available oxygen. $Fe_3O_4$ (black magnetite) is undesirable in a coating because its crystal structure increases friction while offering wear resistance. $Fe_2O_3$ (red hematite) is hard and provides wear resistance, but increases friction significantly. FeO and $Cu_2O$, which decrease friction, are of cubic structure of B1 and C3 (structure brecht notation) respectively, with holes where metal atoms should be. For these lowest oxygen MO oxides, heat and pressure created by sliding generates localized transformations which includes lower friction, such as $FeO \rightarrow Fe_3O_4$ (Fe/O ratio 1:0.95–1.05). In case of $MoO_3$ the crystal structure changes from orthorhombic to monoclinic. For the other metals the transformations would be $Cu_2O \rightarrow CuO$; $NiO \rightarrow Ni_2O$; and $MoO_3 \rightarrow Mo_8O_{21-24}$. The MO structures provide easy slip planes allowing the atoms of the structure to slide against one another.

Light metal substrates are important in engine construction because they reduce the weight of the assembly, but they also serve a useful purpose in connection with plasma spraying of powder in that the high conductivity of the aluminum or magnesium substrate will readily allow transfer of heat away from the coating to prevent bore distortion and to quickly lower the temperature of the coating so that there will be less opportunity for ambient air to react with the hot powder particles after deposition. Cooling air jets directed at the bore wall also serve to cool the coating and wall.

Gas flow rates that facilitate carrying out of plasma spraying in accordance with this invention include a mass flow rate of about 40–100 standard liters per minute for the primary plasma gas and about 2 to 6 standard liters per minute for the aspirating gas. The power supply needed for creating the electric arc/electromagnetic field advantageously is about 10–35 kilowatts.

It is desirable that the introduced powder have a particle size in the range of 40–150 microns to limit the oxide volume formation such as to 30% by volume. Particle sizes smaller than 40 microns create such a large surface area that the oxide content would be inordinately high and the coating inordinately soft or fully melted. Such particle range induces a desirable amount of porosity in the coating in the range of 3–10% porosity. Porosity is useful in the coating as will be described later in that it allows in lubricated applications, the ability to trap oil in the pores which become a reservoir for feeding an oil film on the coating that the adds to the low friction characteristic by maintaining sliding contact therewith in a hydrodynamic friction range.

The primary plasma gas is constituted of a reactively oxide-neutral gas, but includes a reducing component particularly when the oxide form of the introduced powder is less than 90% MO. Such primary plasma gas is advantageously selected from the group of argon, nitrogen, hydrogen and mixtures thereof. Other types of oxide-neutral or inert gases may also be used. The aspiration gas is constituted of a reactively oxide-neutral gas but includes an oxidizing component if the volume content of the oxide form (MO) of the introduced powder is less than 5% or it is desired to increase the volume of the oxide form (MO) to substantially over 5% in the coating.

For example, if the introduced powder is nickel and contains oxide with only 60% being NiO, the primary plasma gas is selected as argon with a 5–30% $H_2$ component and the aspirating gas is selected as argon with up to 20% nitrogen if nitrides in the coating are necessary to increase coating hardness. If the introduced powder contains less than 0.2% $O_2$ combined as an oxide (presumably the oxide is NiO in a low volume content), then the primary plasma gas is selected as 95–100% argon with optionally up to 5% $H_2$, hydrogen being not absolutely necessary. The aspirating gas contains preferably a 90/10 mixture of argon and air. If the introduced nickel powder is relatively free of oxides, the aspirating gas may be constituted up to 50% air, depending on the degree to which it is desired to dynamically create NiO during the spraying process.

In the case of iron or steel as the base metal for the introduced powder, the same type of considerations would apply. Water (steam) atomized iron or steel powder typically contains oxides in the volume content of 2–15% with a total $O_2$ content in the oxide form of 0.1–1.8% by weight. When $O_2$ is greater than 1.0% by weight, some $Fe_2O_3$ and $Fe_3O_4$ will also be present. With such FeO content, very high argon content for the primary plasma gas can be used, with up to 5% hydrogen to induce a slightly higher plasma temperature that facilitates reduction of $Fe_2O_3$ and $Fe_3O_4$ in the presence of hydrogen ions. Hydrogen ions will act as an insurance to seek out oxygen atoms before they have a chance to combine with iron ions and dynamically form unwanted forms of iron oxides, such as $Fe_2O_3$ and $Fe_3O_4$. If the oxide and oxygen content is high, more hydrogen can be used to reduce magnetite and hematite oxide forms which may be present in the powder or are unwantedly formed during the plasma spraying process. With the presence of hydrogen in the primary gas, reduction of these unwanted oxides occurs as follows: $Fe_2O_3+Fe_3O_4+H_2 \rightarrow FeO+H+O_2$.

Hard wear-resistant particles can be designed into the coating by using a nitriding type of gas as a component in the primary plasma gas. For example, if the powder is comprised of a steel containing alloying ingredients of chromium, aluminum or nickel, and the plasma gas has hydrogen ions effective to reduce $Fe_2O_3$ or $Fe_3O_4$ in the presence of carbon ions and nitrogen ions to combine with Fe ions, then hard wear-resistant particles will be $Fe_2N_3$, $FeCrN_3$, and $Fe_3C$. Even in the absence of $H_2$, the alloying ingredients (Cr, Al, Ni) will combine to form nitrides. For example, with chromium being the alloying ingredient, the resulting hard wear-resistant particles will be $Fe(Cr)N_3+Fe_3C$.

Formation of $MO_x$ during the spraying process may also be desirable with starting powders that have low oxide contents. Oxygen exposure to the powder will be limited in the spraying process by admitting air or oxygen only at low flow rates and only as part of the aspirating gas for the powder, never as an addition to the primary plasma gas. Thus, oxygen in the presence of carbon ions, will provide the following reactions for an irons powder: $Fe+O_2 \rightarrow 2FeO$; $C+O_2+Fe_2O_3 \rightarrow FeO+CO_2+CO$.

Figure 6:
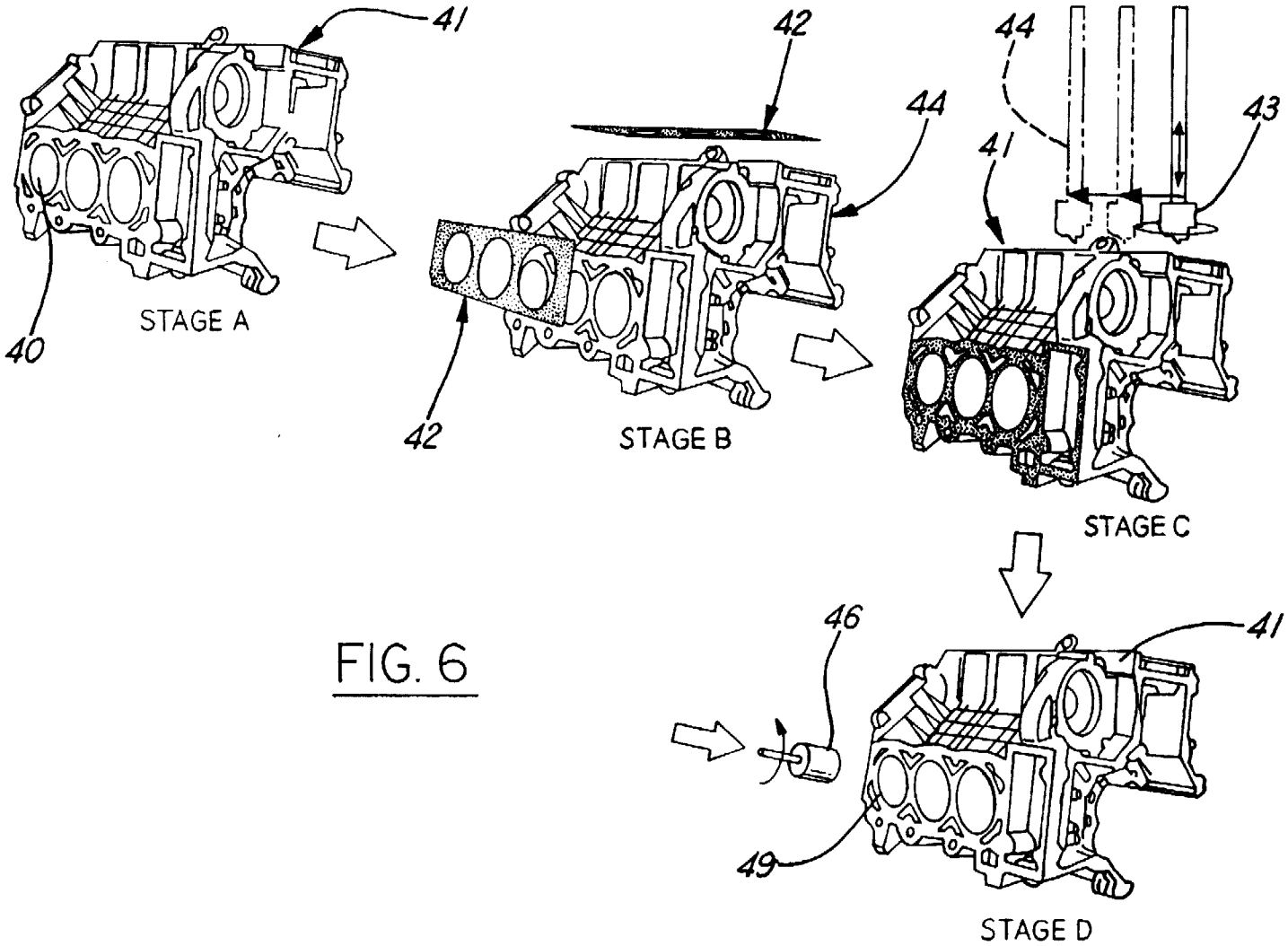
FIG. 6 is a composite illustration of the method steps of this invention as applied to an aluminum cylinder block.

As shown in FIG. 6, the first step of the process requires that the metal substrate surface (cylinder bore surface 40 of an engine block 41) be prepared essentially free of oxides and in a condition to adherently receive the coating (see stage a). This may be accomplished in several different ways, including grit blasting which exposes the fresh metal free of oxide, electrical discharge machining which accomplishes similar cleansing of the surface, very high pressure water jetting and single and multiple point machining such as honing. The preparation creates a surface roughness of about 150–550 micro-inches. Preferably the surface is also degreased with an appropriate degreasing agent, such as trichloroethane, prior to the surface roughening. It is desirable that this step be carried out in close sequence to step (b) of spraying, or a passivating material be used to avoid follow-on oxidation of the prepared surface.

Figures 7, 8, 9:
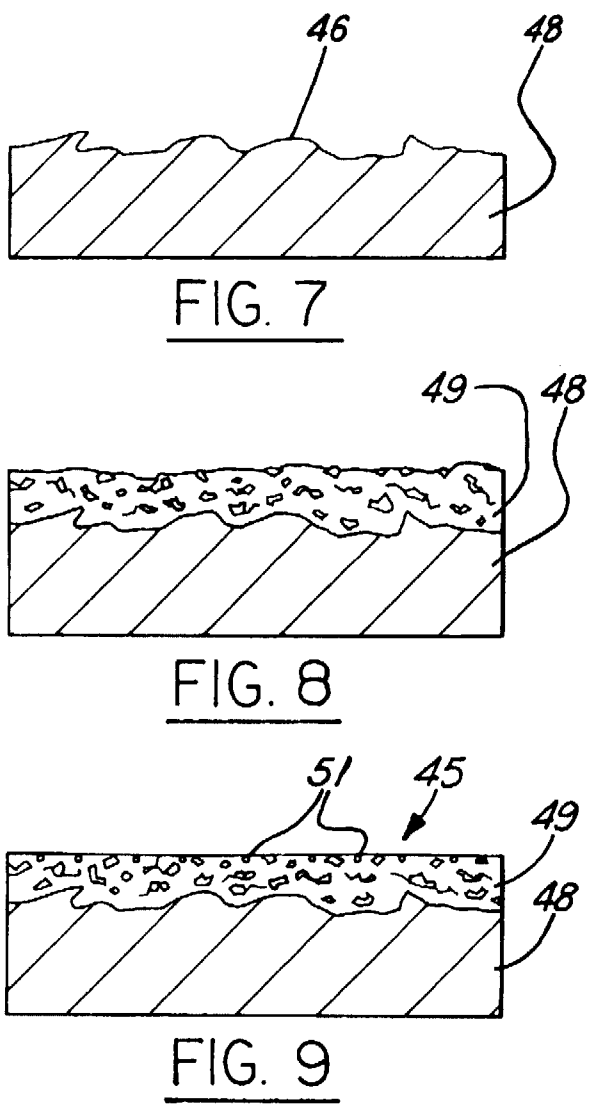
FIG. 7 is a highly enlarged view of the substrate surface prepared for reception of the coating.
FIG. 8 is a highly enlarged view of the surface of FIG. 7 with the coating adherently thereon.
FIG. 9 is a highly enlarged view of the coated surface after finished machining or honing.

It is desirable to employ a bond coating directly on such prepared surface before the outer coating is applied. This may be carried out by thermally spraying a nickel-aluminum composite coating thereon (80–95% Ni). Other bond coats may be 80–95% stainless steel with Al or 80% Ni with Al. The hot bond coat forms intermetallic compounds of Ni-Al/$Ni_3$-Al releasing considerable heat to exothermic reactions which promote a very strong bond. Whether the surface 48 is bond coated or merely cleansed, it will have a surface roughness 46 appearing in FIG. 7, about 150–550 micro-inches.

Next, the substrate surface 48 (cylinder bore wall) is thermally sprayed. This may require masking other surfaces of the component with suitable masking 42, stage b. For an engine block this may involve both a face mask as shown as well as an oil gallery mask (not shown) to limit spray at the other end of the bore wall. Thermal spraying is then carried out, stage c, by inserting a rotary spray gun 43 into the cylinder bores to deposit a bond coat and a top coating as previously described. The gun is indexed to new positions 44 aligned with the bore axes to complete spraying all the bores. The resulting coating 49 will have a surface roughness 50 appearing as in FIG. 8. Finally, the solidified coating 49 is honed to a smooth finish by a rotary honing tool 46, at stage d. The honed surface 45 will appear as that shown in FIG. 9, exposing wear resistant particles 51.

The ultimate coating can be deposited in a variety of thicknesses, but it is desirable not to deposit too thick a coating to avoid delamination due to excessive stresses. For engine block applications, the bore wall coating should be deposited in a thickness range of 0.002–0.003 for the bond coat and 0.005–0.012 for the top coat. To insure the absence of splatters and a more smooth coating level, the following should be done during the spraying operation: (i) rotate or translate the nozzle spray pattern at a constant uniform speed such as 150–300 rpm; and (ii) 0.3–1.2 feet per minute axial speed. The powder is introduced at a flow rate of about 5–18 pounds per minute. The coating is smoothed by honing to a surface finish (i.e., 6–18 micro-inches) that readily accepts an oil film thereon.

The resulting powder plasma spray coated aluminum engine block is characterized by having a unique coated cylinder bore. The coating is constituted of at least 70% by volume of a bore metal (M), such as iron or steel, and an oxide with at least 90% of the oxide being MO. The maximum volume content of $MO_x$ in the coating, when M is Cu, is preferably 12%; the maximum volume is preferably 15% when M is Mo and 30% when M is Fe or Ni. The coating should have a hardness in the range of Ra 45–80, provided the carbon content is in the range of 0.1–0.7. The coating will have a porosity of 1–6%, the pores having a diameter of 1–6 microns. The coating will have an adhesive strength of about 5,000–10,000 psi, as measured by a ASTM bond test. The presence the stable low friction oxide $(MO)_x$ enhances the corrosion resistance of the coating over that of the base metal. And the coating will possess a dry coefficient of friction 0.25–0.4. The oxides will be uniformly distributed throughout the coating to assist in providing scuff resistance as well as a friction (boundary friction) of as low as 0.09–0.12 when lubricated with oil (SAE 10W30).

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

I claim:

1. A method of depositing a metal base coating containing a self-lubricating oxide phase, comprising the steps of:

(a) preparing at least one metal substrate surface to be essentially oxide-free and in a condition to adherently receive the coating;

(b) plasma spraying a supply of metal (M) powder particles, which may contact an oxide of M, onto said substrate surface to produce a composite coating of such metal (M) and of an oxide ($MO_x$) of such metal that has the lowest oxygen content of any of such metal's oxide forms, x being selected so that the oxide (i) has the least molecular oxygen content of any of the metal's oxides and (ii) has sites in the metal's oxide crystal lattice where M is absent to provide the easiest glide planes in such lattice of any of the metal's oxides, the plasma being formed by introduction of a primary plasma gas through an electric arc/electromagnetic field to ionize the primary gas as a plasma stream which stream envelopes each particle of said supply of metal powder, said powder particles being introduced to the plasma stream by an aspirating gas and being melted or plasticized substantially only at a surface region of each particle by the heat of the plasma;

(i) said primary plasma gas being constituted of a reactively oxide-neutral gas, but also including a reducing gas component when the supply of metal (M) contains also an oxide form that is less than 90% by volume $MO_x$ prior to being sprayed, (ii) said aspirating gas being constituted of a reactively oxide-neutral gas, but including an oxidizing component if the volume content of the $MO_x$ in the supplied powder is less than 5% by volume $MO_x$ or it is desired prior to spraying to increase the volume of $MO_x$ in the coating to over 5% in the coating.

2. The method as in claim 1, in which a thermally deposited bond coat is applied to said prepared substrate surface prior to step (b).

3. The method as in claim 2, in which said bond coat is of one of 80–95% by weight Ni with remainder aluminum, 80–95% stainless steel with the remainder aluminum, and about 80% nickel with the remainder chromium.

4. The method as in claim 1, in which the resulting coating contains oxides that are at least 90% by volume $MO_x$ and M constitutes at least 70% by volume of the coating.

5. The method as in claim 1, in which the powder metal (M) is selected from the group consisting of Fe, Ni, Cu, Mo, and alloys of each, and x in the oxide $MO_x$ is 0.95–1.05 when M is Fe, 0.75–1.25 when M is Ni, 0.40–0.60 when M is Cu, and 2.5–3.2 when M is Mo.

6. The method as in claim 5, in which $MO_x$ has a crystal structure characterized by sites where M is absent.

7. The method as in claim 6, in which the maximum volume content of $MO_x$ in the coating is 12% when M is Cu, 15% when M is Mo, and 30% when M is Fe or Ni.

8. The method as in claim 1, in which the size of the introduced powder particles is in the range of 40–150 microns to facilitate melting or plasticizing at the surface region and thereby limit the volume content of the metal oxide in the coating to 30% and also to thereby induce porosity in the coating of 3–10% by volume.

9. The method as in claim 1, in which the powder particles have an irregular or indented shape to promote pores in said coating, the pores having a size of about 1–6 microns.

10. The method as in claim 1, in which the powder is introduced at a flow rate of about 5–18 pounds per minute.

11. The method as in claim 1, in which said primary plasma gas is selected from the group of argon, nitrogen, hydrogen and mixtures thereof.

12. The method as in claim 1, in which said aspirating gas is selected from the group of argon, nitrogen, oxygen, air and mixtures thereof.

13. The method as in claim 1, in which the electric arc/electromagnetic field is induced by a power supply of 10–35 kilowatts and the flow rate of the introduced primary plasma gas is about 45–100 standard liters per minute at a pressure in the range of 20–75 psi, and the flow rate of the aspirating gas is about 2–6 liters per minute at a pressure of about 5–60 psi.

14. The method as in claim 1, in which in step (a) is carried out to produce a surface roughness of 150–550 micro-inches.

15. A method of depositing an iron or steel base coating onto an aluminum cylinder bore wall that receives oil during use, the coating containing a self-lubricating FeO phase and one or more wear resistant phases, comprising the steps of:

(a) preparing at least one surface of said wall to be essentially oxide-free and in a condition to adherently receive the coating;

(b) plasma spraying a supply of iron or steel powder particles, which may contain of an oxide of the iron or steel, onto said surface to produce a composite coating of iron or steel and FeO with pores, the plasma being formed by introduction of a primary plasma gas through an electromagnetic field to ionize the primary gas as a plasma stream which stream envelopes each particle of said supply of powder, the powder being introduced to the plasma stream by an aspirating gas and being melted or plasticized only at a surface region of each particle by the heat of the plasma;

(i) the primary plasma gas being constituted of a reactively oxide-neutral gas, but including a reducing gas component when the oxide of such powder is less than 90% by volume FeO prior to spraying, (ii) the aspirating gas being constituted of a reactively oxide-neutral gas, but including an oxidizing component if the volume content of FeO in the supply of powder is less than 5% FeO or it is desired prior to spraying to increase the volume of FeO in the coating; and (c) smoothing the exposed surface of the coating to induce a hydrodynamic oil film thereon when said oil is applied to the pores of the coating in sliding contact use.

16. The method as in claim 15, in which a bond coat is applied to said prepared surface prior to step (b), said bond coat being selected from Ni-Al (80–95% by wt. Ni), stainless steel-Al (80–95% by wt. stainless steel), and Ni-Cr (about 80% by wt. Ni).

17. The method as in claim 15, in which in step (b) said powder particles contain carbon effective to facilitate reduction of $Fe_3O_4$ or $Fe_2O_3$ during thermal spraying.

18. The method as in claim 15, in which in step (c) is carried out by honing to a surface finish of 6–18 micro-inches.

* * * * *